US006171064B1

(12) United States Patent
Hugenroth et al.

(10) Patent No.: US 6,171,064 B1
(45) Date of Patent: Jan. 9, 2001

(54) REVERSE ROTATION DETECTION FOR SCROLL COMPRESSOR UTILIZING SUCTION TEMPERATURE

(75) Inventors: Jason J. Hugenroth; John R. Williams, both of Arkadelphia, AR (US)

(73) Assignee: Scroll Technologies, Arkadelphia, AR (US)

( * ) Notice: Under 35 U.S.C. 154(b), the term of this patent shall be extended for 0 days.

(21) Appl. No.: 09/046,274

(22) Filed: Mar. 23, 1998

(51) Int. Cl.[7] ..... F04B 49/10
(52) U.S. Cl. ..... 417/32; 418/55.1
(58) Field of Search ..... 417/32, 45, 44.1; 418/55.1, 151

(56) References Cited

U.S. PATENT DOCUMENTS 5,118,260 * 6/1992 Fraser, Jr. ..... 417/18
5,186,613 * 2/1993 Kotlarek et al. ..... 417/291
5,368,446 * 11/1994 Rode ..... 417/18
5,452,989 * 9/1995 Rood et al. ..... 417/29
5,607,288 * 3/1997 Wallis et al. ..... 417/310
5,684,463 * 11/1997 Diercks et al. ..... 340/584
5,690,475 * 11/1997 Yamada et al. ..... 417/32

* cited by examiner

*Primary Examiner*—Henry C. Yuen
*Assistant Examiner*—Mahmoud M Gimie
(74) *Attorney, Agent, or Firm*—Carlson, Gaskey & Olds

(57) ABSTRACT

A scroll compressor is provided with a reverse rotation detection circuit that monitors the temperature adjacent the suction tube. An elevated temperature at the suction tube is indicative of reverse rotation, and if the temperature exceeds a predetermined maximum, then a determination is made that reverse rotation is occurring. Once this determination is made, the rotation of the motor is stopped, or corrected.

9 Claims, 3 Drawing Sheets

REVERSE ROTATION DETECTION FOR SCROLL COMPRESSOR UTILIZING SUCTION TEMPERATURE

BACKGROUND OF THE INVENTION

This invention relates to monitoring of the suction temperature of a scroll compressor to make a determination of when the compressor is running in reverse.

Scroll compressors are becoming widely utilized in many compression applications. Scroll compressors have high efficiency, and thus are becoming very popular. However, there are many challenges during scroll compressor operation.

Essentially, a scroll compressor includes a pair of interfitting scroll wraps each connected to a planar base. One of the wraps is fixed and the other wrap orbits relative to the fixed wrap. The wraps are in contact with each other and define compression chambers for an entrapped fluid. As the orbiting scroll moves relative to the fixed scroll, the size of the compression chambers change to compress the gas.

Scroll compressors are designed to operate in one direction. If there is orbiting movement of the orbiting scroll in the opposed direction, then the scroll compressor is not operating properly. There is unwanted noise, and increased heat in the compressor system. This is undesirable.

One main cause of reverse rotation in scroll compressors is miswiring of the motors. Often, scroll compressors are driven by three phase motors. The three phase motors typically include three power input lines leading from a power supply to the motor. If the lines are misconnected to the motor, then an improper phasing of the voltage may be supplied and the motor may run in reverse. As mentioned above, if a scroll compressor is ran in reverse, the results are undesirable.

SUMMARY OF THE INVENTION

When a scroll compressor is ran in reverse, there is noise and increased temperatures at many locations in the system. One location is the suction tube. Gas is no longer being drawn into the compressor. In fact, applicant has determined that a small quantity of gas passes out of the compressor and through the suction tube. When this occurs, the suction tube quickly reaches an elevated temperature. The housing around the tube also reaches an increased temperature.

The present invention monitors the temperature at or adjacent the suction tube. If a predetermined maximum suction temperature is exceeded, then a determination is made that reverse rotation is occurring. Once the determination is made, the motor is shut down. The motor may be shut down by a control directly to the motor, or the control may communicate to the power supply. As an example, phase reversing circuits are known wherein the phase of two of the three wires is changed. These circuits would result in proper wiring of the three phase motor should an improper connection be initially made. The phase circuits are activated by the temperature sensor.

In the preferred embodiment, the temperature sensor is one which moves from a monitoring position to an actuated position once a particular temperature is reached. As one example, the sensor may include a fusible element which melts when the target temperature is reached. As another example, the sensor may include a member which moves between one of two positions once the temperature is reached, such as a bi-metal snap disk. The sensor may include a manual reset, an automatic reset, or may be one which must be replaced after one actuation. The temperature in the suction tube or adjacent to the suction tube upon reverse rotation may approximate 300° F. The normal operating temperature should not exceed approximately 120° F. Thus, it is quite easy to design an element which will only be actuated upon reverse rotation.

In several embodiments, the sensor may be placed on the suction tube, or on the housing adjacent to the suction tube. Either location will be sufficient for identifying when reverse rotation is occurring.

These and other features of the present invention can be best understood from the following specification and drawings, the following of which is a brief description.

DETAILED DESCRIPTION

Figure 1:
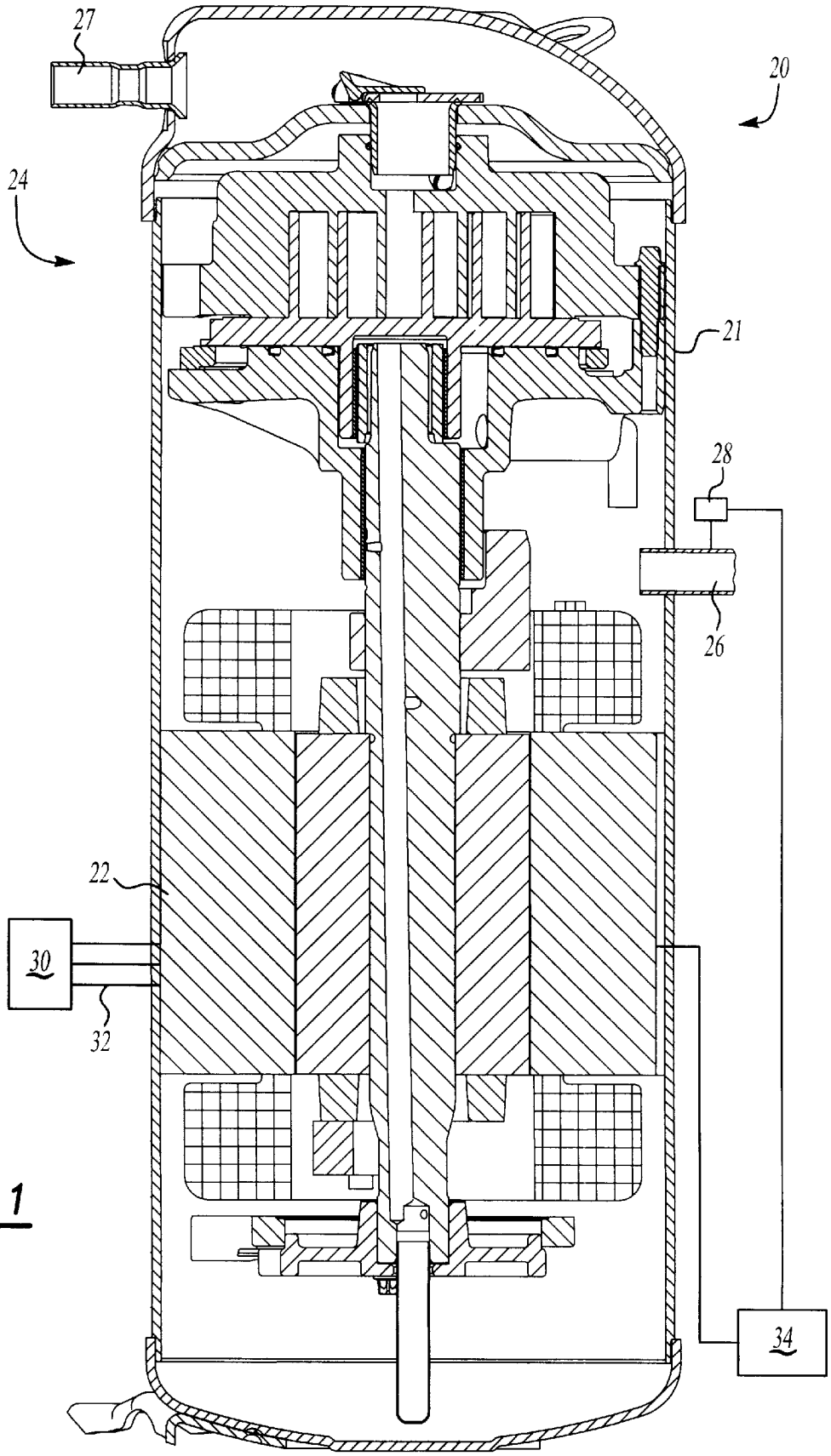
FIG. 1 shows a first embodiment of the present invention.

As shown in FIG. 1, a compressor 20 incorporates a container housing 21 enclosing a motor 22 (shown schematically) and a pump unit 24. As shown, the pump unit is preferably a scroll compressor.

A suction tube 26 leads into the container 21. As known, an outlet tube 27 leaves the container at another location. The container seals the suction tube 26 from the outlet 27. A temperature sensor 28 is mounted on suction tube 26 and monitors the temperature in the suction line 26. The sensor may be mounted at various locations along tube 26. A power supply 30 supplies three phase power 32 to motor 22.

Should the three phase power supply be miswired, then it is possible that the motor 22 will be driven in reverse. This would result in noise and elevated temperatures within compressor 22. One location of elevated temperature would be at the suction tube 26. A small quantity of fluid may leave tube 26 from the compressor 20 when motor 22 is driven in reverse. This will raise the temperature adjacent tube 26.

When temperature sensor 28 senses an elevated temperature that is above a predetermined maximum, a signal is sent to control 34 that reverse rotation is occurring. In the FIG. 1 embodiment, control 34 shuts down motor 22 by some means. As an example, control 34 might blow a fuse to stop the motor 22. Other means of stopping the motor 22 may be used.

Figure 2:
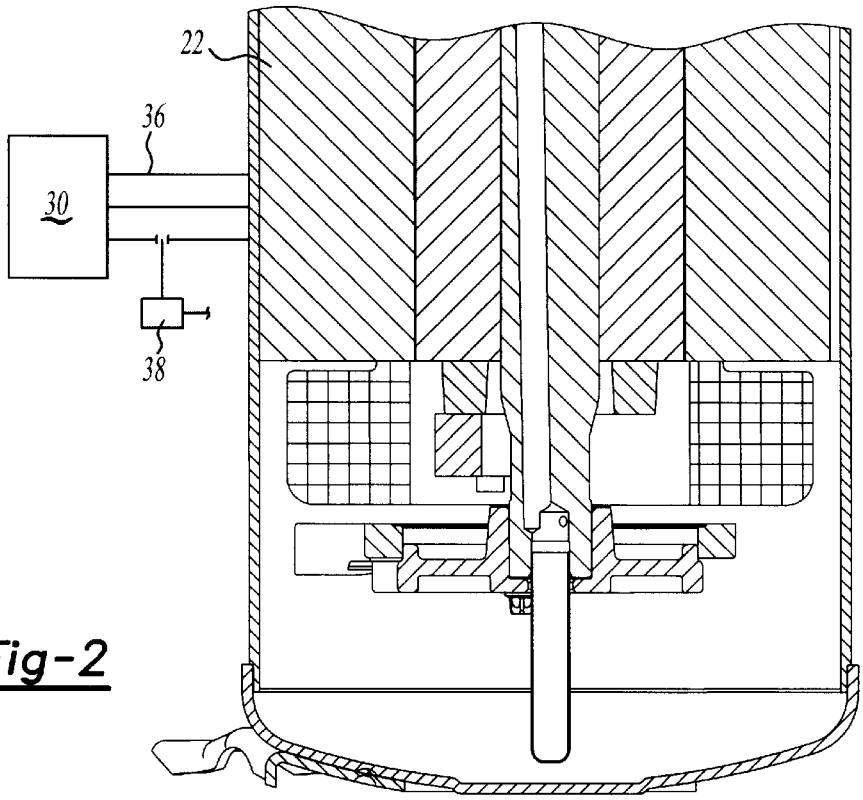
FIG. 2 shows a second embodiment of the present invention.

FIG. 2 shows a second embodiment wherein control 38 is operable to break at least one of the three phase lines 36 from supply 30 to the motor 22 if it is determined that reverse rotation is occurring. The structure for breaking a line could be a structure similar to a circuit breaker or other known elements.

Figure 3:
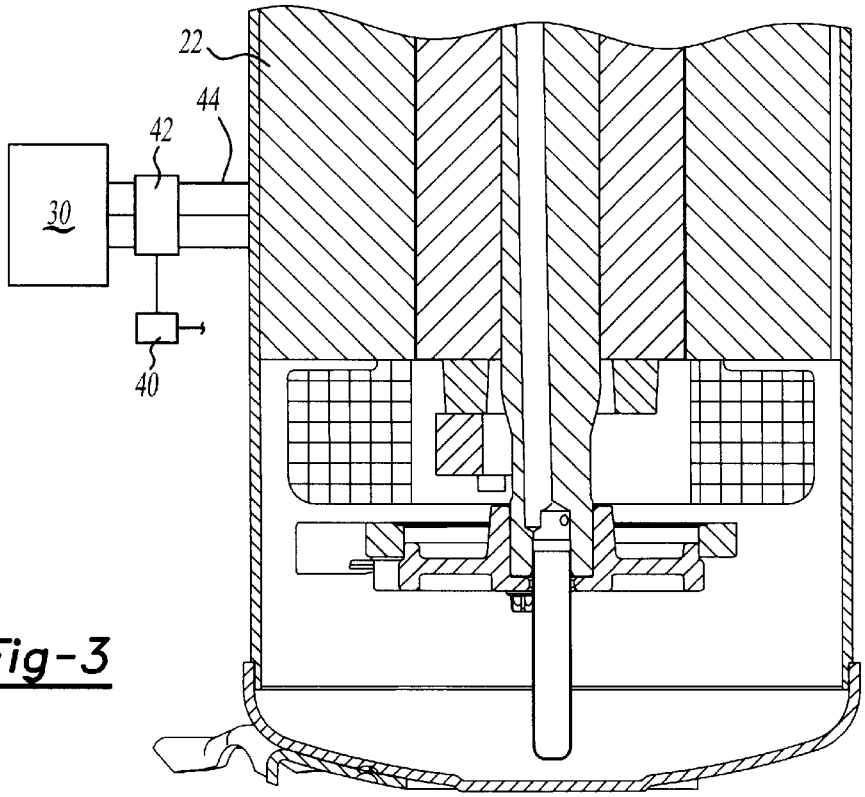
FIG. 3 shows a third embodiment of the present invention.

FIG. 3 shows an automatic correction of reverse rotation. In FIG. 3, the control 40 responds to the determination of reverse rotation by acting in conjunction with a phase reversing circuit 42 to reverse the phase of at least two of the three wires 44 leading to the motor from the power supply 30. By reversing the phase of two of the lines, the control reverses the overall power being supplied to the compressor and will reverse the rotation. Since the motor was rotating in the wrong direction, it will now be rotating in the proper direction. Phase reversing circuits are known and have been used to cause reverse rotation in other type systems, however, they have not been used to correct for improper wiring in scroll compressors.

Figure 4:
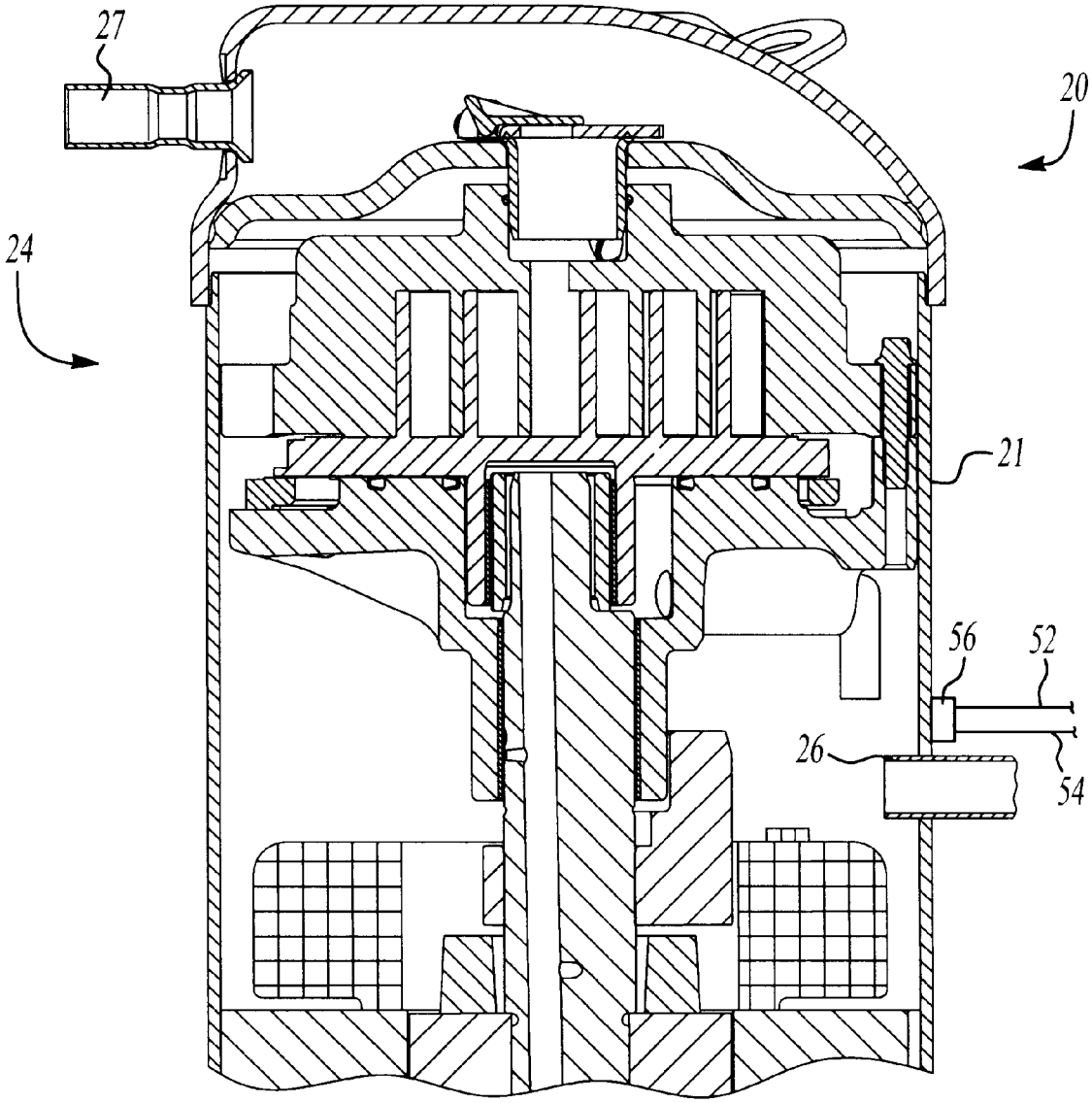
FIG. 4 shows a feature of the present invention.

FIG. 4 shows another embodiment 50 wherein the sensor includes two lines 52 and 54 connected in a fusible portion 56 connected to the housing 21. Lines 52 and 54 lead to the control element. As compared to the FIG. 1 embodiment, the sensor is now mounted on the housing adjacent, rather than directly on, the suction tube 26. The housing adjacent to the suction tube will still be at an sufficiently elevated temperature to actuate the sensor.

If the target temperature is reached, fusible element 56 melts breaking the circuit between lines 52 and 54. The control interprets the break as an indication of reverse rotation. As an alternative to the fusible link, a bi-metal snap disk which actuates at a particular temperature may be utilized.

The fusible link may be one available from Elcot, of Osaka, Japan. The bi-metal snap disk switch may be one known as a fixed temperature thermostat, and available from Texas Instruments. The sensors may be manually reset, automatically reset, or may be of sort which must be replaced after one use.

The invention recognizes that the temperature in the suction tube or adjacent to the suction tube during reverse rotation can be on the order of 300° F. The temperature in the same location during normal operation typically does not exceed 120° F. Thus, there is a very large temperature range which allows this invention to be easily achieved, and appropriate sensors to be designed.

The present invention identifies reverse rotation by monitoring suction temperature, and responding to a determination of an elevated temperature by stopping the reverse rotation. Thus, a very simple approach to detecting and correcting reverse rotation is disclosed.

Although the specific disclosure is to a three-phase motor, reverse rotation can occur in a single phase motor, and this invention will correct for such reverse rotation. Also, although only three phase lines are shown, it should be understood that the type of three phase power supply having four wires also comes within the scope of this invention.

Preferred embodiments of this invention have been disclosed, however, a worker of ordinary skill in the art would recognize that certain modifications will come within the scope of this invention. For that reason, the following claims should be studied to determine the true scope and content of this invention.

What is claimed is:

1. A scroll compressor comprising:

a first scroll wrap member having a wrap extending from a base, and a second scroll member having a wrap extending from a base, said second scroll wrap interfitting with said first scroll wrap to define compression chambers;

an electric motor for driving said second scroll;

a container enclosing said motor and said scroll wraps, a suction tube extending through said container into said container for communicating a suction fluid to be compressed to said compression chambers between said scroll wraps;

a power supply for supplying power to said electric motor; and a suction temperature monitor for monitoring the temperature adjacent said suction tube, and said suction temperature monitor communicating with a control operable to stop rotation of said motor if a determination is made based upon said monitored temperature that said motor is rotating in an improper direction.

2. A scroll compressor as recited in claim 1, wherein said control stops rotation by stopping rotation at said motor.

3. A scroll compressor as recited in claim 2, wherein a fuse is deactivated if a determination is made that reverse rotation is occurring.

4. A scroll compressor as recited in claim 1, wherein said rotation stopping occurs between said power supply and said motor.

5. A scroll compressor as recited in claim 1, wherein said stopping includes breaking at least one of the lines from said power supply to said motor.

6. A scroll compressor as recited in claim 1, wherein said power supply is three phase, and said stopping includes by operating a phase reversing circuit placed between said power supply and said motor.

7. A scroll compressor as recited in claim 1, wherein said suction temperature monitor includes a fusible link which melts at a particular temperature to provide an indication that said motor is rotating in the improper direction.

8. A scroll compressor as recited in claim 1, wherein said sensor is mounted on said container, adjacent to said suction tube.

9. A scroll compressor as recited in claim 1, wherein said sensor is mounted directly on said suction tube.

* * * * *